United States Patent [19]

Daugherty et al.

[11] Patent Number: 4,935,124

[45] Date of Patent: Jun. 19, 1990

[54] ROTATABLE WOOD CHIP CLASSIFIER

[75] Inventors: William D. Daugherty, Hattiesburg, Miss.; James C. Hobbs, Benton, Ak.

[73] Assignee: Internaltional Paper Company, Purchase, N.Y.

[21] Appl. No.: 346,496

[22] Filed: May 2, 1989

[51] Int. Cl.[5] ..... B07B 1/22; B07B 1/46

[52] U.S. Cl. ..... 209/664; 209/237; 209/240; 209/258; 209/284; 209/290; 209/384; 209/389; 209/393

[58] Field of Search ..... 209/664, 288, 406, 407, 209/410, 411, 289, 290, 240, 242, 246, 256, 258, 291, 237, 393, 353, 267, 683, 236, 384, 385, 293, 395

[56] References Cited

U.S. PATENT DOCUMENTS

| | | | |
|---|---|---|---|
| H31 | 3/1986 | Wagner | 209/289 X |
| 108,246 | 10/1870 | Fickinger | 209/284 |
| 325,557 | 9/1885 | Miles | 209/395 |
| 1,709,180 | 4/1929 | Levers | 209/284 |
| 2,270,703 | 1/1942 | Bernard | 209/411 X |
| 2,416,008 | 2/1947 | Kerr | 209/288 X |
| 3,061,094 | 10/1962 | Gaddie | 209/683 X |
| 4,784,761 | 11/1988 | Okvist | 209/664 X |

FOREIGN PATENT DOCUMENTS

| | | | |
|---|---|---|---|
| 137616 | 6/1950 | Australia | 209/289 |
| 457085 | 9/1913 | France | 209/393 |
| 492316 | 1/1976 | U.S.S.R. | 209/406 |
| 6925 | of 1808 | United Kingdom | 209/394 |

*Primary Examiner*—Donald T. Hajec

*Attorney, Agent, or Firm*—Walt Thomas Zielinski

[57] ABSTRACT

A rotatable wood chip thickness classifying device. The apparatus includes two coaxial, spaced sets of apertured discs, each set defining a drum. The interdisc spacing of each drum is uniform, each drum having a different interdisc spacing from the other drum. For each set of discs, the inside diameter of adjacent discs alternates. Wood chips are fed into the interior of the first drum, this drum having a typical disc interspacing of 2 mm. The common axis of drum rotation is slightly tilted to the horizontal and chips of less than 2 mm fall through the interdisc openings of the first drum. The remainder of the chips pass to the interior of the second drum, typically of 8 mm interdisc spacing. Chips less than 8 mm fall through the interdisc openings of the second drum. The alternation of inside disc diameters, for each drum, yields a chip tumbling effect to thereby inhibit an elongated chip, of a diameter of less than 2 mm for example, from straddling the 2 mm openings and not falling therethrough.

17 Claims, 5 Drawing Sheets

FIG. 1
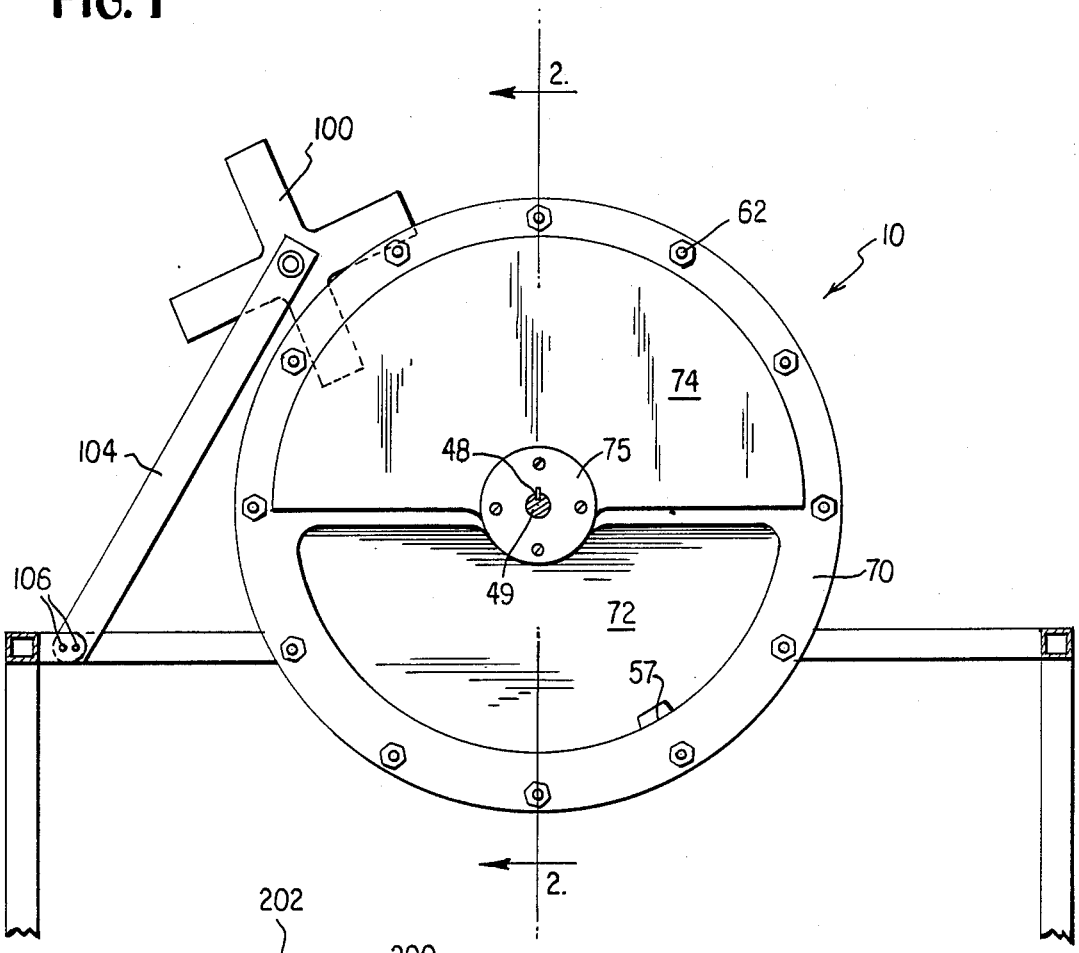
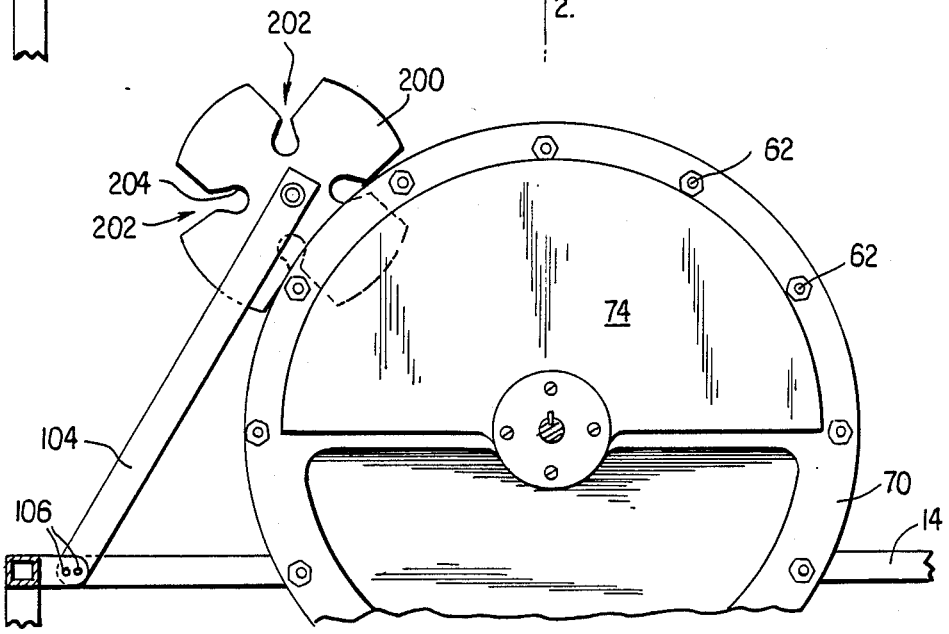
FIG. 5

ROTATABLE WOOD CHIP CLASSIFIER

BACKGROUND OF THE INVENTION

This invention relates to a classifier and more particularly to a rotary classifier formed by a plurality of aligned, spaced rings for sorting or grading wood chips. Classifiers are useful in the paper making art wherein it is often desireable to sort or grade wood chips into different sizes, with each size corresponding to different effects on the paper making process. Each size classification will itself be, in practice, a range of sizes. While wood chip rotary classifiers for size sorting are known, they are relatively expensive. Wood chips typically are of irregular shape with some also being significantly longer than others. Most of the rotary classifiers of the plural ring type are defined by a series of parallel, apertured discs, or rings, with the product to be classified fed into one end of the drum-like structure defined by the rings. When the chips to be classified are all substantially spherical or cubical, no particular problem arises. Namely, all of the substantially spherical or cubical chips whose maximum dimension is less than the interdisc spacing will fall through the spaces between the discs. When, however, the chips include some which are elongated, there arise occasions wherein the interdisc spacing is spanned by one or more of such elongated chips whose volume is such that they should, desireably, fall between the disc spacing. This spanning behavior of elongated chips results in a less than maximum efficiency of classification, with the result that after the initial classifying step, some of the smaller (but elongated) chips remain in the classifying apparatus and pass on to the next classifying stage, where they may then pass through the next stage interdisc openings and become comingled with larger volume wood chips.

SUMMARY OF THE INVENTION

According to the practice of this invention a rotary disc classifier is constructed from a plurality of coaxial, parallel discs of different alternate inside diameters to thereby yield a tumbling motion on chips being classified and thus inhibit the straddling of relatively elongated wood chips across the interdisc spacing, where without such straddling they would otherwise pass between the discs. A second drum, of similar construction, is preferably secured in end to end (series) relationship with the first drum and is coaxial therewith. This second drum also produces a tumbling effect of the wood chips fed to it due to different internal diameters of adjacent rings.

Further according to this invention, a classifier drum driving arrangement is utilized which automatically closes an aperture or passage between serially arranged classifier drums while an initial charge of wood chips is being classified, with the operation being such that after an initial chip classifying time interval, the whole series classifier unit is rotated in the opposite direction and this interdrum aperture automatically opens to permit the passage of the residium of the initial charge of wood chips to a second classifier drum. During a second chip classifying interval or period, an exit orifice in the second drum is automatically closed by means of a semicircular cover carried by the rotating shaft of the drums. Further according to this invention, cleaning devices operate continuously so that chips which become wedged between adjacent discs are dislodged upon each drum revolution.

BRIEF DESCRIPTION OF THE DRAWINGS

FIG. 1 is an end view of the lower one of the two drums of the classifier of this invention, as indicated by section 1—1 of FIG. 2.

FIG. 5 is an illustration, similar to FIG. 1, of an alternate form of an interdisc cleaner element.

DETAILED DESCRIPTION OF THE INVENTION

Figure 2:
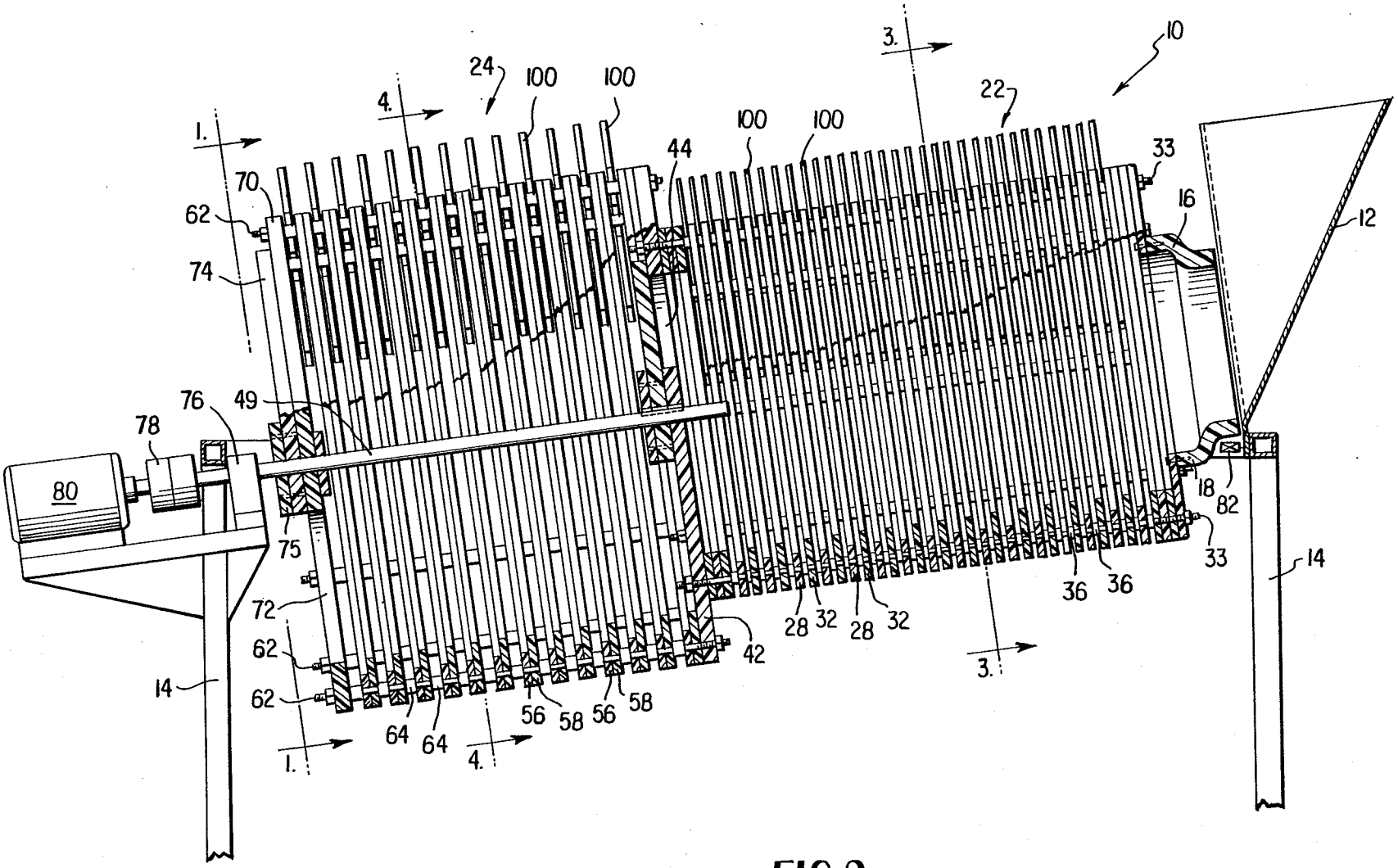
FIG. 2 is a partial longitudinal cross sectional view, as indicated by section 2—2 of FIG. 1.

Referring now to FIGS. 1–4 of the drawings, the numeral 10 denotes generally the double drum wood chip classifier of this invention and includes an input trough 12 adapted to receive wood chips. The numeral 14 denotes generally a supporting frame or base member of tubular metal stock for holding and supporting the chip classifier and a driving motor 80 therefor. The numeral 16 denotes a double diameter, hollow feed member having a right or input end closely spaced adjacent to a discharge opening in one wall of feed trough 12. The numeral 18 denotes any one of a plurality of angularly disposed fastening elements securing one end of a first drum classifier 22 to annular feed member 16. The numeral 24 denotes a second drum classifier member. Drums 22 and 24 are coaxial and have a common axis of rotation which is tilted with respect to the horizontal, as shown at FIG. 2.

Referring now to the first classifier drum 22, the numeral 28 denotes any one of a first plurality of apertured discs or rings, typically of metal or rigid plastic. The numeral 32 denotes any one of a second plurality of apertured discs or rings, rings 28 and 32 being serially arranged such that next adjacent rings are of different inside diameters and alternate (every other) rings are of the same inside diameter. The outside diameters of rings 28 and 32 are the same, while the inside diameter of any ring 28 is greater than the inside diameter of any ring 32. The rings are held together in spaced, parallel and coaxial relationship by a plurality of angularly disposed rods 33 passing therethrough upon which are mounted spacer washers 36. The thickness of the spacer washers determines the spacing between the rings. Typically, this spacing is 2 mm. Adjacent rods 33 are closely spaced at about 4½ inches between centers to promote rigidity of the rings.

The left end of drum 22, being the lower end as indicated at FIG. 2, is provided with a cover plate 42 having an opening or passage 44 therein. Cover plate 42 is held against the lower end of drum 22 by nuts associated with rods 33.

Opening 44 is selectively covered and uncovered by a semicircular junction closure plate 46, to be described later. A keyway and key, both denoted as 48, in longitudinal driveshaft 49 couples junction closure plate 46 to the driveshaft, such that upon rotation of shaft 49 by motor 14, junction closure plate 46 will rotate. A hub 50 is attached to one surface of closure plate 46 by a plurality of fasteners, as indicated. Drum 22 is rotatably supported at the narrow end of feed member 16 by a pair of roller elements.

Turning now to the second or lowermost drum 24 as shown in FIG. 2, the numeral 58 denotes any one of a first plurality of apertured discs or rings. The numeral 56 denotes any one of a second plurality of apertured discs or rings, the latter rings 56 having a larger inside diameter than rings 58. As indicated, rings 56 and 58 pairwise contact each other, with the arrangement being such that next adjacent rings are of different inside diameters. The external diameter of the rings 56 and 58 is the same. The numeral 62 denotes any one of a plurality of angularly spaced rods, passing through rings 56 and 58, each rod carrying a plurality of spacer washers 64. Washers 64 determine the spacing between contacting pairs of rings 56, 58. The thickness of washers 64, as their counterparts 33 in the first drum 22, determines the maximum size of wood chips which will pass out of a respective drum. The numeral 76 schematically denotes a rotary bearing support for shaft 49 at its lower end, with numeral 78 denoting a coupling to electric motor 80. The lower end of drum 24 is closed by circular end plate 70 having a semicircular opening 72. A semicircular closing plate 74 is provided with a hub 75, both the plate and its attached hub provided with a key and keyway for coupling shaft 49 to the plate and hub 75, the numeral 48 again denoting the key and keyway.

Figure 3:
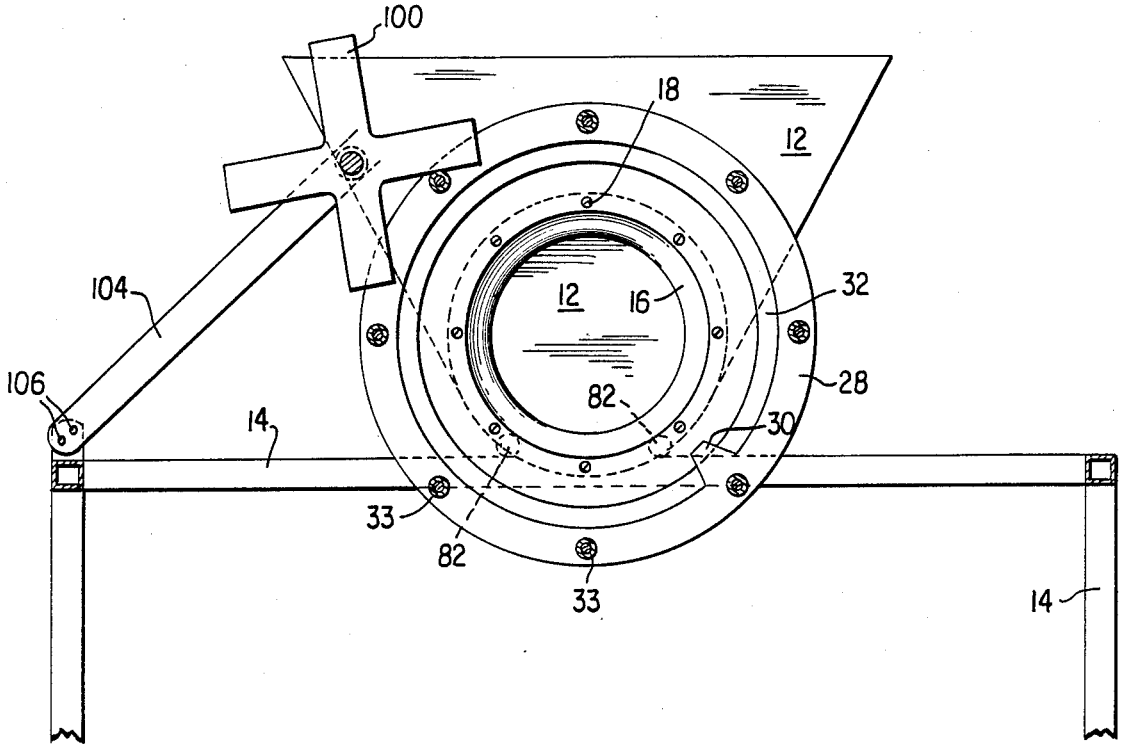
FIG. 3 is a transverse cross sectional view taken along section 3—3 of FIG. 2.

Referring now to FIG. 3 of the drawings, the numeral 30 denotes a radially inwardly directed tooth integral with each ring 28 of drum 22. The purpose of these teeth is to inhibit a wood chip of substantially spherical shape from continually riding in a valley whose edges are defined by the radially inwardmost portions of adjacent rings 32. By virtue of teeth 30, any such wood chips are carried upwardly during drum rotation from their bottom positions in the drum, thence upwardly, until they fall into the drum at other, lower points along the drum. This action can continue until the lowest part of the drum is reached. Similarly, at FIG. 4, the numeral 57 denotes a corresponding tooth on each ring 56 of second drum 24. The action of teeth 57 is the same as that of teeth 30.

Figure 4:
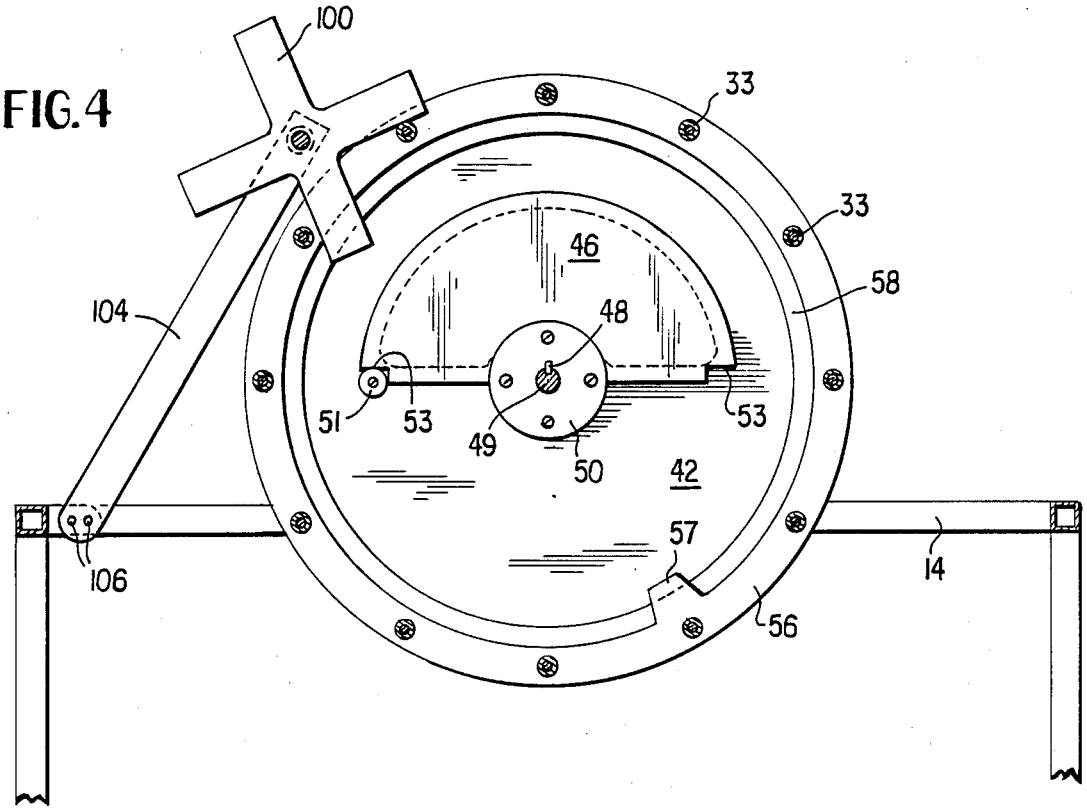
FIG. 4 is a transverse cross sectional view taken along section 4—4 of FIG. 2.

Referring now to FIG. 4, the numeral 53 denotes either one of two notches at the end of junction closure plate 46 and adapted to alternately engage a driving pin 51 mounted on plate 42. Viewing FIG. 4, the reader will readily comprehend that with counter clockwise rotation of shaft 49, junction closure plate 46 will assume the indicated position relative to driving pin 51, such that left notch 53 will drive plate 42 and hence drum 22 in the same direction. In the configuration indicated at FIG. 4, passage 44 between the two drums 22 and 24 is closed by junction closure plate 46.

FIG. 1 illustrates the configuration which obtains upon initiation of operation of the classifying process. Namely, a charge of wood chips has been placed in trough 12 and has passed through feed member 16 into the interior of first drum 22. Drum rotation by electric motor 80 now proceeds for a predetermined period of time. Wood chips of less than a predetermined size, typically 2 mm, are removed from the first drum 22 by falling through the spacings between adjacent rings 28,32. After this predetermined time, the motor 80 is stopped and reversed in direction of rotation. This causes junction closure plate 46, as shown as FIG. 4, to turn substantially 180 degrees, with the other (right) notch 53 now bearing on drive pin 51 from below the latter, to thereby rotate drum 22 in the opposite direction. This automatically opens passage 44 in plate 42 and permits the remainder of the initial charge of wood chips to pass from the first to the second drum.

Upon reversal of direction of rotation of motor 14 junction closure plate 46 and end cover plate 74 move together by virtue of key and keyway 48. Opening 72 in plate 70 is closed by plate 74. Thus, upon the opening of passage 44, opening 72 of lower drum 24 is automatically closed. During a second predetermined interval (after the initial charge of wood chips has passed from the first to the second drum) a further classification action occurs, with chips of a predetermined maximum size passing through the interdisc spacings of the second drum 24, the spacing being typically 8 mm. During this second phase of the classifying action, cover plate 74 covers opening 72 by having rotated 180 degrees.

After the second phase of the classifying action has occurred, the motor 80 is stopped and reversed in direction of rotation for a third phase. In this last action, cover plate 74 is rotated 180 degrees to uncover opening 72. With opening 72 uncovered, the (large) wood chips still residing in the second drum exit the drum through opening 72.

To dislodge wood chips which may have jammed in the spacings of each drum, cleaner elements 100 are provided. Each such element is defined by a cross and is formed of rigid material such as metal or a hard plastic, pivoted on a shaft 102 and fully rotatable thereon. The cleaners 100 are spaced apart a distance substantially equal to the interdisc spacing of a respective drum, with each shaft 102 being rigidly supported at a respective end by a frame 104 rigidly bolted to support 14 as indicated at 106. Upon rotation of the first and second drums, spacers 36 on rods 33 of drum 22 engage the arms of their respective cleaner elements 100, to thereby rotate the latter, with the arms extending into the interdisc spacing zones to thereby dislodge any wood chips which may be stuck or jammed therein. The same dislodging action occurs with respect to rotation of the cleaner elements 100 associated with second drum 24, by virtue of striking the spacers 64 of rods 62.

Modified cleaner elements 200 are shown in FIG. 5, similar in action to elements 200, and are each defined by a disc with four notches 202 each opening on the disc perimeter. The bottom of each notch is provided with a curved recess 204, each of the latter sequentially engaging a washer 64 on rod 62 as drum 24 rotates. This causes a continued rotation of each cleaner disc 200, with the vanes thereof entering the interdisc spaces to dislodge jammed wood chips. Cleaners 200 may be installed and operated on the first or second drum in essentially the same manner as cleaner elements 100.

Figure 6:
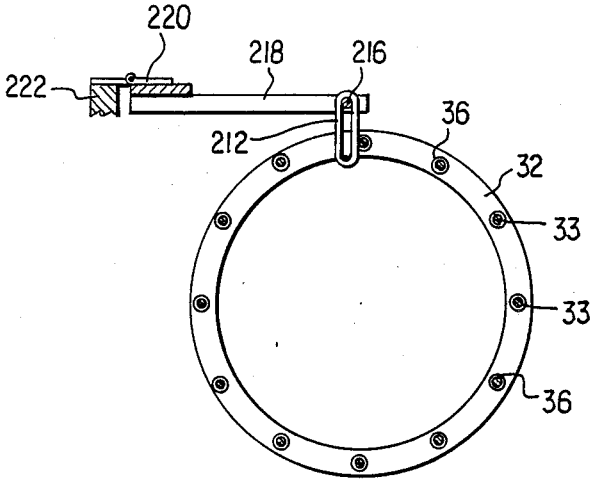
FIG. 6 is an illustration of a different form of a cleaner element, in combination with a disc.
Figure 7:
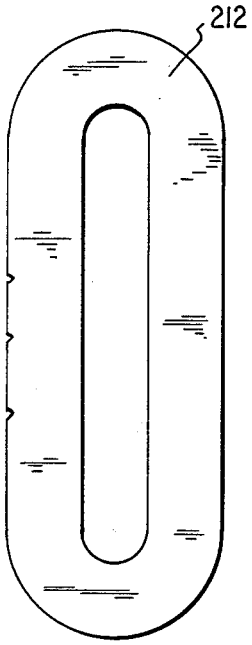
FIG. 7 is a magnified side elevational view of the cleaner element of FIG. 6.

Referring now to FIGS. 6 and 7, another modified interdisc cleaner arrangement is shown. A cleaner element 212 is in the general shape of a rectangle with integral semicircular ends, with a central slot 214, is freely mounted on a rod 216. The latter is carried by an arm 218 pivotally mounted by hinge 220 on support 272. Cleaner elements 212 are spaced apart on shaft 216 at a distance substantially equal to the interdisc spacing of a respective drum 22, 24 by spacer collars fixed on 216. The cleaner elements are each independently rotatable on shaft 216 and are each independently movable perpendicular to the shaft within the limits of their slot length. Upon the rotation of the drum 22, spacers 36 on rods 36 engage the cleaners element 212, causing the cleaner elements to rotate on shaft 216 and enter the interdisc spaces to strike and dislodge jammed wood chips. Any seriously jammed wood chip which is not unjammed by a single action of a cleaner element will receive an additional strike from a cleaner element 212 on each drum rotation until the chip is unjammed.

Figure 8:
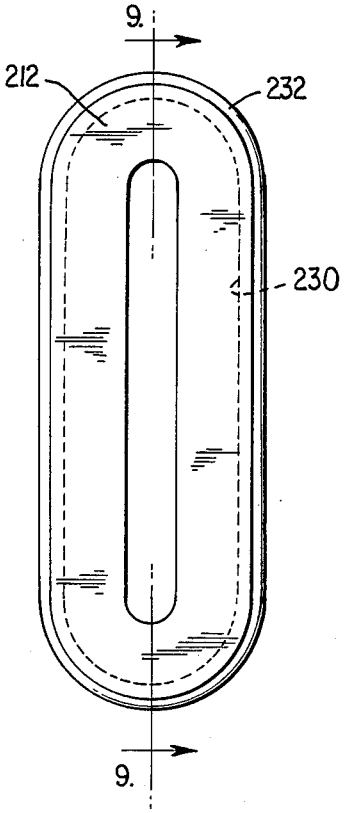
FIG. 8 is a side elevational view, similar to FIG. 7, of a still further modified cleaner element.
Figure 9:
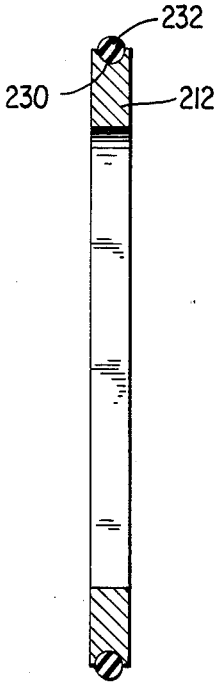
FIG. 9 is a view taken along section 9—9 of FIG. 8.

FIGS. 8 and 9 illustrate a modified form of cleaner element 212 wherein the outer periphery is provided with a continuous groove 230 which receives an elastomer ring 232. Cleaner elements 212 are preferred for use with drum 24 because cleaner element 212 may rise above any jammed chip which protrudes extensively from the drum perimeter, while continuing to deliver a striking force to unjam each chip on each drum revolution.

The rings 56, 58 of second drum 24 may be arranged in the same manner as the rings of drum 22 if desired.

Figure 10:
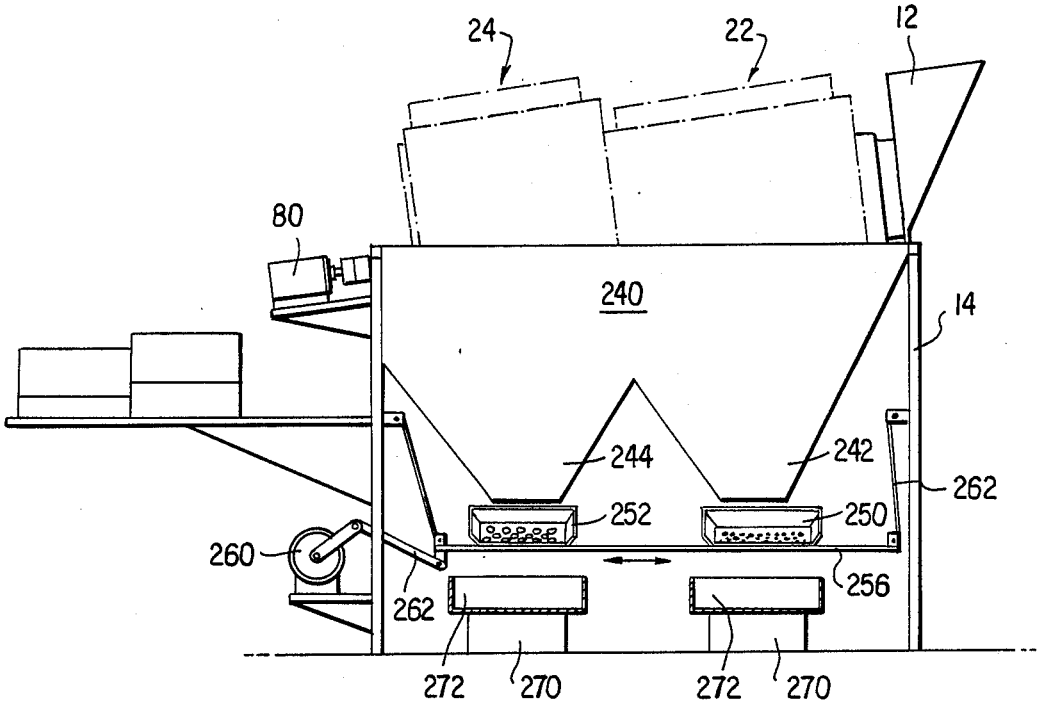
FIG. 10 is a partially schematic side elevational view of an oscillating tray apparatus to further sort wood chips.
Figure 11:
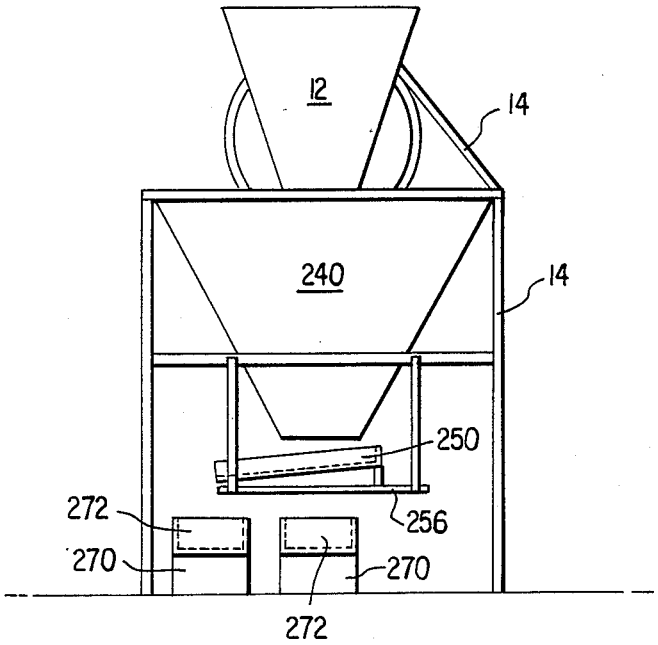
FIG. 11 is an end elevational view of the oscillating tray apparatus of FIG. 10.

Further in accordance with the invention, apparatus will now be described for further sorting the wood chips by length or by overall size. This additional apparatus is shown at FIGS. 10 and 11. There, a hopper 240 is positioned to receive the discharge from classifier drums 22, 24, the hopper having first and second respective discharge funnels 242, 244. Two trays 250 and 252 are each supported on suspended, oscillating table 256, the latter driven horizontally to and fro by a motor 260 and associated linkage 262 of any conventional design.

Tray 250 is provided with 5 mm round holes and is located beneath the 2 mm thickness sorting drum 22. This tray sorts out the sawdust and small particles from the larger thin chips.

The other tray 252 is provided with 45 mm round holes and is located beneath the 8 mm thickness sorting drum 24 and beneath the drum 24 discharge opening 72. During the 8 mm sort, tray 252 allows chips of short length and width to pass through the 45 mm round holes. The wide and long chips pass over the end of the tray. During the emptying cycle for drum 24, this tray again sorts for wide and long chips.

In the most preferred form, a group of four electronic weighing scales 270 with pans 272 for collecting and weighing the chips are appropriately located to receive all material from the oscillating trays. The scales, and also drive motor 260 may be integrated with a computer or microprocessor controller. In this way, the computer can control and command the sequencing of the sorting drum rotation, and may also record scale weighings at appropriate times.

The relative proportions of the different size wood chips produced by the sorting processes, compared with the total weight of all the sorted wood chips in one batch sample, may then be readily calculated by the computer. The resulting data may be printed and/or stored in memory for other historical statistical report generation, or can be directed to some other computer for use in process control.

What is claimed is:

1. A wood chip classifier, said classifier including a drum having a longitudinal axis about which said drum is rotatable, said drum being open ended at one entrance end thereto to receive wood chips of different sizes, said drum defined by first and second coaxial sets of relatively fixed apertured discs, the discs of said first set being interdigitated in substantial parallelism with the discs of said second set, the inside diameters of the discs of said first disc set being smaller than the inside diameters of the discs of said second disc set, whereby the inside diameters of next adjacent discs are different, and whereby the inside diameters of alternate discs are the same, the interdisc spacing between next adjacent discs being substantially the same, whereby the difference in inside diameters of next adjacent discs yeilds a chip tumbling effect which inhibits elongated chips, having a length greater than the interdisc spacing and having a thickness less than the interdisc spacing, from straddling the interdisc spacing and not passing therethrough and out of the first drum.

2. The wood chip classifier of claim 1 wherein all discs are in relative fixed relations.

3. The wood chip classifier of claim 1 including a radially inwardly directed tooth on discs with the relatively larger inside diameter to inhibit a wood chip of substantially spherical shape from continually riding in the valley defined by the radially inwardmost portions of adjacent discs with the relatively smaller inside diameter.

4. The wood chip classifier of claim 1 including means to continuously dislodge jammed wood chips from said interdisc spacing during the classification action.

5. The wood chip classifier of claim 4 wherein the apertured discs are maintained in said relatively fixed relationship to each other by a plurality of angularly spaced rods each of which carries a plurality of spacers, and wherein the means to continuously dislodge jammed wood chips includes a plurality of crosses of rigid material, each cross being rotatable about a common fixed axis generally parallel to said classifier longitudinal axis, the arms of each cross extending into a respective interdisc space and being sequentially engaged by said spacers on said rods to thereby rotate said arms upon drum rotation.

6. The wood chip classifier of claim 4 wherein the apertured discs are maintained in said relatively fixed relationship to each other by a plurality of angularly spaced rods, each of which carries a plurality of spacers, and wherein the means to continuously dislodge jammed wood chips includes a plurality of slotted rectangles with semicircular ends, each rectangle being independently rotatable about a common axis generally parallel to said classifier longitudinal axis, and each rectangle being independently movable perpendicular to said common axis within the limits of the said slot, with the common axis carried by arms pivotally mounted to the fixed frame of the classifier, the rectangles extending into respective interdisc spaces and being engagable by said spacers on said rods to thereby rotate said rectangles to enter into the respective interdisc spaces upon drum rotation, and with said rectangles being independently movable and pivotally mounted to allow the rectangles to initially not enter any interdisc spaces containing jammed wood chips.

7. A wood chip classifier of claim 6 wherein the outer peripheries of said rectangles are each provided with a continuous groove fitted with an elastometer ring.

8. A wood chip classifier, said classifier including a drum having a longitudinal axis about which said drum is rotatable, said drum being open ended at one entrance end thereto to receive wood chips of different sizes, said drum defined by first and second coaxial sets of pairwise arranged apertured discs, the discs of said first set being in pairwise surface contact with the discs of the second set to define a plurality of pairs of discs, the inside diameters of the discs of said first disc set being smaller than the inside diameters of the discs of said second disc set, whereby the inside diameters of next adjacent discs are different, and whereby the inside diameters of alternate discs are the same, the spacing between pairs of next adjacent discs being substantially the same, whereby the difference in inside diameters of next adjacent discs a chip tumbling effect which inhibits elongated chips, having a length greater than the interdisc spacing and having a thickness less than the interdisc spacing, from straddling the interdisc spacing and not passing therethrough and out of the first drum.

9. The wood chip classifier of claim 8 wherein all discs are in relative fixed relations.

10. The wood chip classifier of claim 8 including a radially inwardly directed tooth on discs with the relatively larger inside diameter to inhibit a wood chip of substantially spherical shape from continually riding in the valley defined by the radially inwardmost portions of adjacent discs with the relatively smaller inside diameter.

11. The wood chip classifier of claim 8 including means to continuously dislodge jammed wood chips from said interdisc spacing during the classification action.

12. A wood chip classifier including at least two coaxial, rotatory drums having a common, tilted longitudinal axis about which the classifier is rotatable, each drum including a plurality of spaced apertured discs and a plurality annular, interdisc openings, said interdisc openings of the drums being uniform within each drum and being different for each of the two drums to thereby classify wood chips of different sizes, one end of said first drum being fixed adjacent one end of said second drum to form a junction between said drums, an apertured plate fixed at said junction and spanning the end of said first drum at said junction, a junction closure plate selectively covering and uncovering the aperture of said apertured plate, said first drum being higher than said second drum, whereby an initial charge of wood chips to be classified is placed in the first drum for a predetermined minimum time and the aperture of the apertured plate is closed, and whereby the aperture of the apertured plate is thereafter opened to permit the initial charge of wood chips to pass from the first drum to the second drum for further classification.

13. The wood chip classifier of claim 12 including a drive pin fixed to said apertured plate, a rotatable drive shaft fixed to said closure plate, said closure plate being substantially semicircular shaped and normally having either one of two driving niches thereof in bearing, driving engagement with said drive pin, said cover plate closing the aperture of the apertured plate in one direction of rotation of said rotatable drive shaft while uncovering the aperture of the apertured plate in the other direction of rotation.

14. The wood chip classifier of claim 13 wherein that end of said second drum remote from said apertured plate is the lowermost end and is provided with a semicircular cover to partially cover said second drum, said semicircular cover being fixed to said rotatable drive shaft.

15. The wood chip classifier of claim 13 wherein said semicircular cover and said closure plate are fixed on said rotatable drive shaft in such an angular phase relation to each other that, when said rotatable drive shaft is rotated in one direction, the lower half of the lowermost end of said second drum is uncovered by said semicircular cover and said closure plate covers the aperture in said apertured plate, and when said rotatable drive shaft is rotated in the opposite direction the lower half of the lowermost end of said second drum is covered by said semicircular cover and said closure plate uncovers the aperture of the apertured plate, whereby when the closure plate uncovers the aperture in said apertured plate, an initial charge of wood chips passes from said first to said second drum and is inhibited from exiting from the second drum by the semicircular cover while the initial charge of wood chips undergoes further classification in said second drum.

16. The wood chip classifier of claim 15 wherein, after classification, oversize material exits the drum through the end of the second drum.

17. The wood chip classifier of claim 15 including means to continuously dislodge jammed wood chips from said interdisc spacings of the two drums during the classification action.

* * * * *